US009243508B2

(12) United States Patent
Morgan et al.

(10) Patent No.: US 9,243,508 B2
(45) Date of Patent: Jan. 26, 2016

(54) SYSTEM AND METHOD FOR RECIRCULATING A HOT GAS FLOWING THROUGH A GAS TURBINE

(75) Inventors: Victor John Morgan, Greenville, SC (US); Thomas James Brunt, Greenville, SC (US); Richard William Johnson, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 982 days.

(21) Appl. No.: 13/424,414

(22) Filed: Mar. 20, 2012

(65) Prior Publication Data

US 2013/0247580 A1 Sep. 26, 2013

(51) Int. Cl.
*F01D 9/02* (2006.01)

(52) U.S. Cl.
CPC ..... *F01D 9/023* (2013.01); *F23R 2900/00012* (2013.01)

(58) Field of Classification Search
CPC ..... F01D 11/005; F01D 25/12; F01D 9/023; F05D 2240/11; F05D 2240/57; F23R 2900/00012; F23R 2900/03042; F23R 2900/03043; F05B 2260/603
See application file for complete search history.

(56) References Cited

U.S. PATENT DOCUMENTS

| | | | | |
|---|---|---|---|---|
| 4,742,961 | A | | 5/1988 | Starke |
| 4,845,939 | A | | 7/1989 | Jordan et al. |
| 5,211,533 | A | | 5/1993 | Walker et al. |
| 5,265,412 | A | | 11/1993 | Bagepalli et al. |
| 5,407,319 | A | * | 4/1995 | Harrogate et al. ..... 415/115 |
| 5,414,999 | A | | 5/1995 | Barnes |
| 6,102,329 | A | | 8/2000 | Guinan et al. |
| 6,412,268 | B1 | | 7/2002 | Cromer et al. |
| 6,450,762 | B1 | | 9/2002 | Munshi |
| 6,481,959 | B1 | | 11/2002 | Morris et al. |

(Continued)

FOREIGN PATENT DOCUMENTS

EP 1900906 A2 3/2008

OTHER PUBLICATIONS

GE Power Systems GER-3935B (10/00), Power Systems for the 21st Century—"H" Gas Turbine Combined-Cycles, R.K. Matta, G.D. Mercer, R.S. Tuthill.

(Continued)

*Primary Examiner* — Phutthiwat Wongwian
*Assistant Examiner* — Stefan Ibroni
(74) *Attorney, Agent, or Firm* — Dority & Manning, PA

(57) ABSTRACT

A system for recirculating a hot gas flowing through a gas turbine generally includes a transition piece having a downstream surface, a stationary nozzle having a leading edge surface adjacent to the transition piece downstream surface, a gap defined between the transition piece downstream surface and the stationary nozzle leading edge surface, and a projection having an inner arcuate surface radially separated from an outer surface. The projection generally extends from the stationary nozzle leading edge surface towards the transition piece downstream surface and at least partially decreases the gap. A seal extends across the gap and may be in contact with the transition piece and the stationary nozzle leading edge surface. A recirculation zone may be at least partially defined between the projection inner arcuate surface, the stationary nozzle leading edge surface and the transition piece downstream surface.

18 Claims, 3 Drawing Sheets

(56) References Cited

U.S. PATENT DOCUMENTS

| | | | | |
|---|---|---|---|---|
| 6,720,088 | B2 * | 4/2004 | Zhao et al. | 428/615 |
| 6,942,445 | B2 * | 9/2005 | Morris et al. | 415/1 |
| 2005/0123389 | A1 | 6/2005 | Morris et al. | |
| 2008/0166233 | A1 | 7/2008 | Johnson et al. | |
| 2009/0115141 | A1 | 5/2009 | Simmons | |
| 2009/0324387 | A1 | 12/2009 | Turaga | |
| 2011/0048030 | A1 | 3/2011 | Berry et al. | |

OTHER PUBLICATIONS

EP Search Report and Written Opinion dated Nov. 12, 2013, issued in connection with corresponding EP Patent Application No. 13159328.7.

Unofficial English translation of Office Action issued in connection with corresponding CN Application No. 201310090340.3 on May 15, 2015.

* cited by examiner

SYSTEM AND METHOD FOR RECIRCULATING A HOT GAS FLOWING THROUGH A GAS TURBINE

FIELD OF THE INVENTION

The present invention generally involves a system and a method for recirculating a hot gas flowing through a gas turbine. In particular, the system and method relate to recirculating a hot gas ingested into a gap between a transition piece and a stationary nozzle within a gas turbine.

BACKGROUND OF THE INVENTION

Industrial gas turbines generally include a plurality of combustors disposed in an annular array about an axial centerline of the gas turbine. Hot gases of combustion flow from each combustor through a transition piece and across a first-stage of stationary nozzles. Because the transition piece and the stationary nozzles are formed of different materials and are subjected to different temperatures during operation, each may experience different degrees of thermal growth as the gas turbine cycles through various operating modes. As a result, the transition piece and the first-stage of stationary nozzles may move radially, circumferentially and axially relative to one another. Also, similar relative movement may occur as a result of dynamic pulsing of the combustion process.

Typically, thermal growth variations are addressed by providing a gap between the transition piece and the first-stage of the stationary nozzles. In addition, one or more seals may be provided to seal the gap and thereby reduce cold air leakage into the hot gas path. However, due to the high pressure and temperature of the hot gas flowing across the gap, at least a portion of the hot gas may be ingested into the gap and flow against the seal, thereby degrading the seal over time.

One method for cooling the seal and for purging the hot gas from the gap includes flowing a purge medium such as compressed air into the gap at a pressure sufficient to purge the gap and/or cool the seal. Although this method is generally effective, larger gaps require a greater volume of the purging medium to affectively purge the gap. As a result, the greater volume of unburned and/or unmixed purging medium may increase the levels of undesirable combustion emissions such as, but not limiting of, nitrogen oxide (NOx) and/or carbon monoxide (CO). Thus, an improved system and method for recirculating the hot gas ingested into the gap would be useful.

BRIEF DESCRIPTION OF THE INVENTION

Aspects and advantages of the invention are set forth below in the following description, or may be obvious from the description, or may be learned through practice of the invention.

One embodiment of the present invention is a system for recirculating a hot gas flowing through a gas turbine. The system generally includes a transition piece having a downstream surface, a stationary nozzle having a leading edge surface adjacent to the transition piece downstream surface, a gap defined between the transition piece downstream surface and the stationary nozzle leading edge surface, and a projection having an inner arcuate surface radially separated from an outer surface. The projection generally extends from the stationary nozzle leading edge surface towards the transition piece downstream surface and at least partially decreases the gap. A seal extends across the gap and may be in contact with the transition piece and the stationary nozzle leading edge surface. A recirculation zone may be at least partially defined between the projection inner arcuate surface, the stationary nozzle leading edge surface and the transition piece downstream surface.

Another embodiment of the present invention is a gas turbine having a combustor which includes a transition piece that has a downstream surface. The transition piece at least partially defines a hot gas path within the gas turbine. A stationary nozzle having a leading edge surface is generally adjacent to the transition piece downstream surface. The stationary nozzle at least partially defines the hot gas path. A gap is at least partially defined between the transition piece downstream surface and the stationary nozzle leading edge surface and may be in fluid communication with the hot gas path. A projection having an inner arcuate surface radially separated from an outer surface extends from the stationary nozzle leading edge surface towards the transition piece downstream surface. The projection may at least partially decrease the gap. A seal extends across the gap and may be in contact with the transition piece downstream surface and the stationary nozzle leading edge surface. A recirculation zone may be at least partially defined between the projection inner arcuate surface, the stationary nozzle leading edge surface and the transition piece downstream surface. The recirculation zone may be in fluid communication with the hot gas path.

A transition piece, that includes a downstream end, at least partially defines a hot gas path within the gas turbine. A stationary nozzle having a forward end adjacent to the transition piece downstream end. The stationary nozzle forward end at least partially defines the hot gas path through the gas turbine. A gap is defined between the transition piece downstream end and the stationary nozzle forward end and the gap is in fluid communication with the hot gas path. A projection having an inner arcuate surface radially separated from an outer surface extends from the stationary nozzle forward end towards the transition piece downstream end. The projection may at least partially decrease the gap. A seal in contact with the aft frame and the projection outer surface extends across the gap and a first volume is at least partially defined between the seal, the projection outer surface and the transition piece downstream end. A second volume may be at least partially defined between the projection inner arcuate surface, the stationary nozzle forward end and the transition piece downstream end, and the second volume is in fluid communication with the hot gas path.

The present invention may also include a method for recirculating the flow of the hot gas flowing into the gap defined between the transition piece downstream surface and the stationary nozzle leading edge surface where the stationary nozzle leading edge surface includes a projection having an inner arcuate surface radially separated from an outer surface. The projection extends from the stationary nozzle leading edge surface towards the transition piece downstream end and the transition piece and the stationary nozzle at least partially define a hot gas path. The method includes flowing the hot gas through the transition piece, flowing a portion of the hot gas into the gap, directing the portion of the hot gas along the stationary nozzle projection inner arcuate surface towards the transition piece downstream surface, flowing the portion of the hot gas across at least a portion of the transition piece downstream surface, directing the portion of the hot gas away from the transition piece downstream surface, and flowing the portion of the hot gas into the hot gas path.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
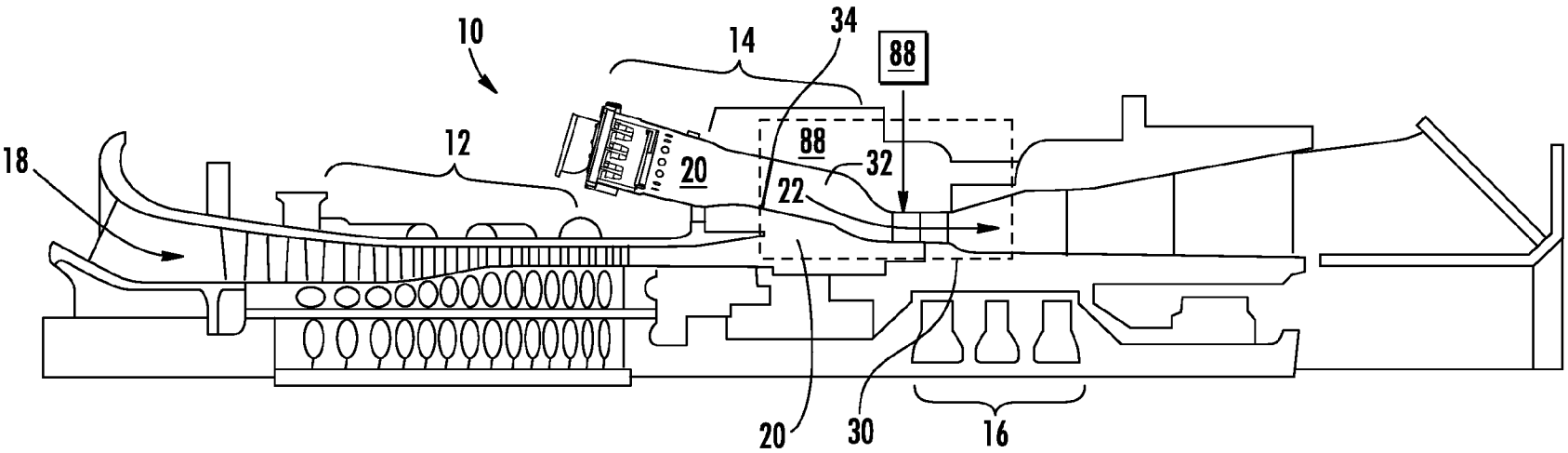
FIG. 1 is a schematic of a gas turbine as may be related to the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. In addition, as used herein, the terms "first", "second", and "third" may be used interchangeably to distinguish one component from another and are not intended to signify particular structure, location, function, or importance of the individual components.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and a method for recirculating a hot gas flowing through a gas turbine. The system generally includes a transition piece having an aft end and a stationary nozzle having a forward end that is generally adjacent to the transition piece aft end. The transition piece and the stationary nozzle may be mounted within the gas turbine so that a gap may be generally defined between the transition piece aft end and the stationary nozzle forward end. The gap may be at least partially decreased by a projection having an inner arcuate surface radially separated from an outer surface that generally extends from the stationary nozzle forward end towards the transition piece aft end. A seal that is in contact with the transition piece and the projection outer surface may extend across the gap. The seal may at least partially define a volume between the projection outer surface and the transition piece aft end. A recirculation zone generally radially inward from the volume may be at least partially defined between the projection inner arcuate surface, the stationary nozzle forward end and the transition piece aft end. In particular embodiments, the transition piece and the stationary nozzle may at least partially define a hot gas path that extends through a portion of the gas turbine. In addition, the gap and/or the recirculation zone may be in fluid communication with the hot gas path. In this manner, as the hot gas flows through the transition piece and across the gap, at least a portion of the hot gas may be ingested into the gap. As the hot gas enters the gap it may flow into the recirculation zone where it may be guided away from the seal by the projection arcuate surface and towards a portion of the transition piece aft end. As the hot gas flows towards the transition piece aft end, the flow direction is reversed and the hot gas is channeled back in to the hot gas path. Although exemplary embodiments of the present invention will be described generally in the context of a system for recirculating a hot gas flowing through a gas turbine for purposes of illustration, one of ordinary skill in the art will readily appreciate that embodiments of the present invention may be applied to any turbo-machine and should not be limited to a gas turbine unless specifically recited in the claims.

Figure 2:
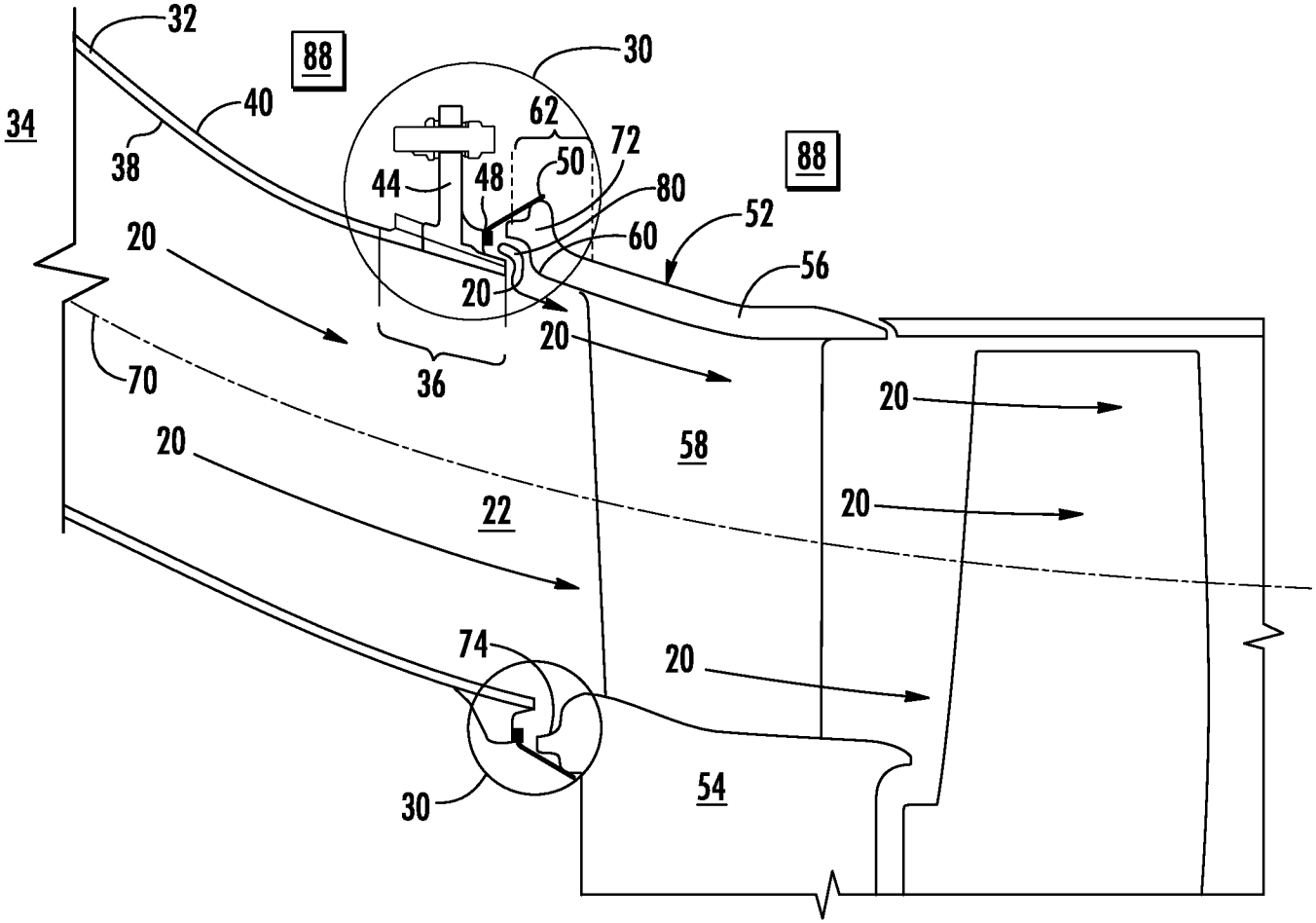
FIG. 2 is cross-sectional view of a portion of a gas turbine according to at least one embodiment of the present invention.
Figure 3:
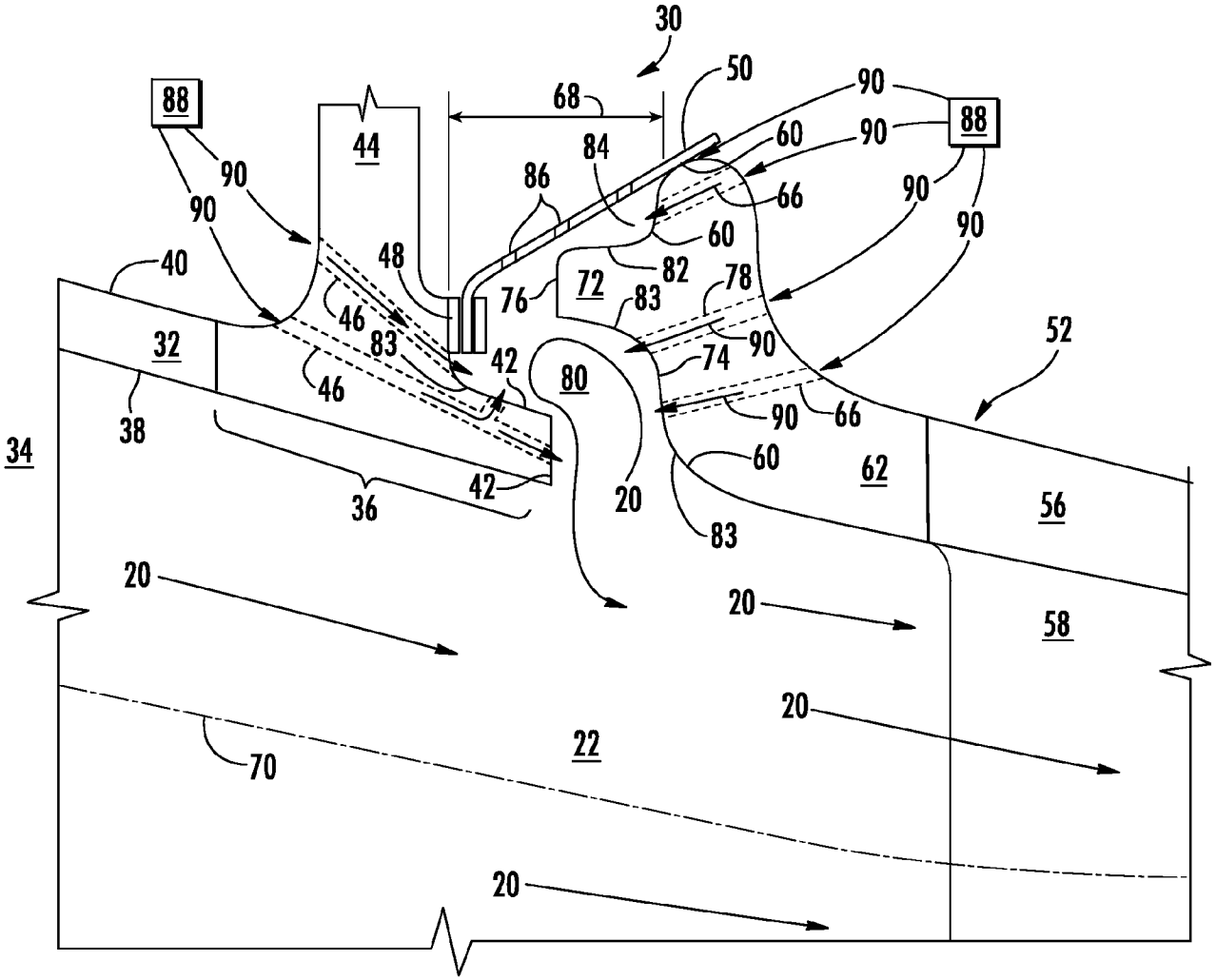
FIG. 3 is an enlarged cross-sectional view of a portion of the gas turbine as shown in FIG. 2.

FIG. 1 illustrates a schematic view of a gas turbine 10, FIG. 2 illustrates a cross-sectional view of a portion of the gas turbine according to at least one embodiment of the present invention, and FIG. 3 illustrates an enlarged cross-sectional view of a portion of the gas turbine as shown in FIG. 2. As illustrated in FIG. 1, the gas turbine 10 may include a compressor 12, a combustor 14 in fluid communication with the compressor 12 and a turbine 16 downstream and in fluid communication with the combustor 14. Although a single combustor 14 is shown, the gas turbine 10 may include a plurality of combustors 14 in fluid communication with the compressor 12 and the turbine 16. In operation, a working fluid 18, such as air, flows through the compressor 12 to provide a compressed working fluid to the combustor 14. The compressed working fluid is mixed with a fuel and ignited within the combustor 14, thereby creating a rapidly expanding hot gas 20. The hot gas 20 generally flows along a hot gas path 22 that extends through the combustor 14 and the turbine 16. As the hot gas flows through the turbine 16, energy from the hot gas is transferred to a plurality of turbine buckets attached to a turbine shaft causing the turbine shaft to rotate and produce mechanical work. The mechanical work produced may drive the compressor 12 or other external loads, such as a generator (not shown) to produce electricity.

As illustrated in FIGS. 2 and 3, the gas turbine may include a system 30 for recirculating the flow of the hot gas 20 flowing through the hot gas path 22. The system 30 may generally include a transition piece 32 that extends at least partially through the combustor 14. The hot gas 20 produced in the combustor 14 shown in FIG. 1, generally flows through an upstream end 34 of the transition piece 32 and out a downstream end 36 of the transition piece 32, as shown in FIGS. 2 and 3. The transition piece 32 generally includes an inner surface 38 radially separated from an outer surface 40. As shown in FIG. 3, the downstream end 36 includes a downstream surface 42 that extends generally radially between the inner surface 38 and the outer surface 40 and that extends generally circumferentially around the downstream end 36. The downstream surface 42 may be at least partially flat and/or at least partially arcuate in shape. In particular embodiments, as shown in FIGS. 2 and 3, the downstream end 36 may include a support frame 44. The support frame 44 may at least partially circumferentially surround the downstream end 36 shown in FIG. 3. The support frame 44 may be welded to the downstream end 36 or may be cast as an integral part of the transition piece 32.

In particular embodiments, the downstream surface 42 may be at least partially defined by at least a portion of the support frame 44, The transition piece 32 and/or the support frame 44 may he made of any material designed to withstand high temperatures that result from the hot gas flowing through the transition piece 32. In particular embodiments, the downstream end 36 may include one or more purge passages 46 that extend therethrough. For example, the one or more purge passages 46 may extend through a portion of the support frame 44. As shown in FIGS. 2 and 3, the transition piece 32 may include one or more connection features 48 such as, but not limiting of, slots, clips or bolts to connect one or more seals 50 to the downstream end 36 of the transition piece 32. In particular embodiments, at least a portion of the downstream end 36 such as, but not limiting of, the support frame 44 and/or the downstream surface 42, may be coated with a heat resistant material such as, but not limiting of, a thermal barrier coating. The transition piece 32 may be mounted to a combustor casing (not illustrated) or to any generally static structure of the gas turbine 10.

As shown in FIGS. 2 and 3, a stationary nozzle 52 may be disposed generally downstream from the transition piece 32 downstream end 36. As shown in FIG. 2, the stationary nozzle 52 may include an inner platform 54 radially separated from an outer platform 56. One or more airfoils 58 may extend between the inner and the outer platforms 54, 56. As shown in FIGS. 2 and 3, the stationary nozzle 52 may also include at least one leading edge surface 60 that is disposed at a forward end 62 of the inner platform 54 and/or the outer platform 56. The leading edge surface 60 may be generally flat and/or arcuate and may extend at least partially radially and circumferentially across the forward end 62 of the inner platform 54 and/or the outer platform 56. As shown in FIG. 3, the stationary nozzle 52 may also include one or more passages for flowing a purge medium and/or a cooling medium through the stationary nozzle 52. In particular embodiments, the leading edge surface 60 may include one or more purge passages 66 that extend through the leading edge surface 60. The hot gas path 22 may be at least partially defined by the stationary nozzle 52 and the transition piece 32. In this manner, the hot gas 20 may flow through the transition piece 32 and across the stationary nozzle 52 as the hot gas enters the turbine 16.

A gap 68 may be at least partially defined between the transition piece 32 downstream surface 42 and the stationary nozzle 52 leading edge surface 60. The gap may be generally axial relative to a centerline 70 that extends through the hot gas path 22. The gap 68 generally provides sufficient separation between the transition piece 32 downstream surface 42 and the stationary nozzle 52 leading edge surface 60 so that the surfaces 42, 60 are unlikely to make contact during operation of the gas turbine 10. In particular embodiments, the gap 68 may be large enough to allow fluid communication between the hot gas path 22 and the gap 68. As the gas turbine 10 cycles through various operating conditions, the gap 68 may increase or decrease In particular embodiments, as shown in FIGS. 2 and 3, a projection 72 generally extends from the stationary nozzle 52 leading edge surface 60 towards the transition piece 32 downstream surface 42. In this manner, the projection 72 at least partially decreases the gap 68 between the transition piece 32 downstream surface 42 and the stationary nozzle 52 leading edge surface 60. As shown in FIG. 3, the projection 72 generally includes an inner arcuate surface 74. The inner arcuate surface 74 may extend from the stationary nozzle 52 leading edge surface 60 to a distal end 76 of the projection 72. The distal end 76 may be any shape. For example, but not limiting of, the distal end 76 may be generally flat, arcuate, slotted or grooved. The inner arcuate surface 74 is generally curved radially outwards relative to the centerline 70 of the hot gas path 22. The inner arcuate surface 74 may be any radius that may encourage a fluid such as, but not limiting of, a hot gas to flow along the inner arcuate surface 74 towards the transition piece 32 downstream surface 42.

One or more purge passages 78 may extend through at least a portion of the projection 72. A second volume, herein referred to as "recirculation zone 80" may be at least partially defined between the stationary nozzle 52 leading edge surface 60, the projection 72 inner arcuate surface 74 and the transition piece 32 downstream surface 42. The recirculation zone 80 may be in fluid communication with the hot gas path 22. In this manner, any fluid such as, but not limiting of, hot gas that may flow into the recirculation zone may be directed away from the seal 50 and back into the hot gas path 22. The projection 72 also includes an outer surface 82 that is generally radially separated from the inner arcuate surface 74. The outer surface 82 generally extends from the distal end 76 of the projection 72 to the stationary nozzle 52 leading edge surface 60. The outer surface 82 may be at least partially arcuate and/or at least partially flat.

In particular embodiments, at least a portion of the stationary nozzle 52 leading edge surface 60 and/or the projection 72 may include a heat resistant material 83 such as, but not limiting of, a thermal barrier coating. The stationary nozzle 52 may be mounted to a turbine casing (not illustrated) or to any generally static structure of the gas turbine 10. In particular gas turbine designs, the transition piece 32 and the stationary nozzle 52 may be mounted to the same generally static structure, or in alternate configurations, to different static structures. Each static structure may have different thermal growth rates. As a result, the gap 68 may increase or decrease as the gas turbine cycles through various operating conditions.

The seal 50 generally extends across the gap 68 between the transition piece 32 and the stationary nozzle 52. The seal 50 may include any type of seal designed to withstand the thermal stresses imposed by the hot gas 20 flowing through the hot gas path 22. The seal 50 may be connected to the transition piece 32 downstream end 36 and may extend across the gap 68 to the leading edge surface 60. In the alternative, the seal 50 may be connected to the leading edge surface 60 and may extend across the gap 68 to the transition piece 32 downstream end 36. The seal 50 may be spring loaded to enhance and/or maintain contact between the seal 50 and the transition piece 32 and/or the stationary nozzle 52. In particular embodiments, the seal extends across the gap 68 from the transition piece 32 downstream end 36 and is in contact with the leading edge surface 60 at a point generally radially outward from the projection 72 outer surface 82. In this configuration, the seal 50 may not make contact with the projection 72 outer surface 82. In this manner, less of the hot gas 20 flowing through the recirculation zone may reach the seal 50, thereby reducing the thermal stresses on the seal 50. In addition, the seal 50, the projection 72 outer surface 82 and the transition piece 32 downstream surface 42 may at least partially define a purge volume 84 that is in fluid communication with the recirculation zone 80. In particular embodiments, the seal 50 may include one or more passages 86 that extend through the seal 50. The one or more passages 86 may allow a fluid to flow through the seal and into the purge volume 84.

In particular embodiments of the present invention, as shown in FIG. 3, the hot gas 20 may flow through the transition piece 32, across the gap 68 and past the stationary nozzle 52. As the hot gas 20 flows across the gap 68, a portion of the hot gas 20 may be ingested into the gap 68. As the hot gas 20 enters the gap 68 it may be channeled into the recirculation zone 80 by the stationary vane 52 leading edge surface 60. As the hot gas 20 enters the recirculation zone 80, the projection 72 inner arcuate surface 74 directs the hot gas 16 away from the seal 50 and towards the transition piece 32 downstream surface 42, thereby reducing thermal stresses on the seal 50. The transition piece 32 downstream surface 42 may redirect the hot gas 20 back to the hot gas path 22 where the recirculated hot gas 20 may combine with the remainder of the hot gas 20 flowing through the hot gas path 22, thereby reducing the thermal stresses on the seal 50 and/or at least partially increasing the efficiency of the gas turbine 10. In addition or in the alternative, the heat resistant coating 83 may protect the stationary nozzle 52 leading edge surface 60, the projection 72 and/or the transition piece 32 downstream surface 42.

In further embodiments, the system 30 may include a purge medium supply 88. For example, but not limiting of, the purge medium supply 88 may include the compressor 12 and/or an external purge medium supply (not illustrated) such as a steam line. The purge medium supply 88 may provide a purge medium 90 such as, but not limiting of, compressed air or steam, into the gap 68. In particular embodiments, the purge medium 90 may flow into the purge volume 84 between the seal 50 and the projection 72 outer surface 82. In this manner, the purge medium 90 may provide cooling to one or more of the seal 50, the projection 72, the stationary nozzle 52 leading edge surface 60 or the transition piece 32 downstream surface 42. In addition, the purge medium 90 may flow between the projection 72 distal end 76 and the transition piece 32 downstream surface 42 and into the recirculation zone 80. As a result, the purge medium 90 may reduce and/or prevent the hot gas 20 from leaking from recirculation zone 80 into the purge volume 84. As a result, the purge medium 90 may provide a motive force to the recirculation zone 80 for driving the hot gas 20 through the recirculation zone 80 and back into the hot gas path 22. In addition or in the alternative, the purge medium 90 may flow into the purge volume 84 and/or the recirculation zone 80 through the one or more transition piece 32 downstream end purge passages 46, thereby at least partially cooling to the transition piece 32 and/or providing a motive force for flowing the hot gas 20 through the recirculation zone 80. In addition or in the alternative, the purge medium 90 may flow through the one or more stationary nozzle 52 leading edge purge passages 66 and/or the one or more projection purge passages 78, thereby at least partially cooling the leading edge surface 60 and/or the projection 72 and/or providing a motive force to the recirculation zone 80 for recirculating the hot gas 20 through the recirculation zone 80 and into the hot gas path 22.

Although the system 30 is illustrated and generally describe between the stationary nozzle 52 outer platform 56 and the transition piece 32 downstream surface 42, it should be obvious to one of ordinary skill in the art that the system 10 may be deployed with similar purpose and results between the stationary nozzle 52 inner platform 54 leading edge surface 60 and the transition piece 32 downstream surface 42. In addition, although the system 10 is described and illustrated with a single transition piece 32 and a single stationary nozzle 52, the system 30 may he deployed on a plurality of transition pieces and a plurality of stationary nozzles within the gas turbine 10 with similar purpose and results.

The system 30 shown and described with respect to FIGS. 1, and 3 may also provide a method for recirculating the flow of the hot gas 20 that flows into the gap 68 between the stationary nozzle 32 leading edge surface 60 and the transition piece 32 downstream. surface 42. The method generally includes flowing the hot gas 20 through the transition piece 32 and flowing a portion of the hot gas 20 into the gap 68. The method further includes directing the portion of the hot gas 20 along the stationary nozzle 32 projection 72 inner arcuate surface 74 towards the transition piece 32 downstream surface 42, flowing the portion of the hot gas 20 across at least a portion of the transition piece 32 downstream surface 42, directing the portion of the hot gas 20 away from the transition piece 32 downstream surface 42, and flowing the portion of the hot gas 20 into the hot gas path 22. In further embodiments, the method may include flowing the purge medium 90 into the gap 68.

The various embodiments shown and described with respect to FIGS. 2 and 3, provide one or more commercial and/or technical advantages over previous systems for recirculating the hot gas 20 flowing through the gas turbine 10. For example, but not limiting of, the recirculation zone 80 defined by the stationary nozzle 32 leading edge surface 60, the projection 72 inner arcuate surface 74 and the transition piece 32 downstream surface 42 provides a flow path for the hot gas 20 that may enter the gap 68 between the transition piece 32 downstream surface 42 and the stationary nozzle 32 leading edge surface 60, thereby reducing thermal stress on the seal 50 and/or decreasing the volume of purge medium 90 required to purge the gap 68 of the potentially damaging hot gas 20. In addition or in the alternative, the decrease in purge medium 90 flowing into the hot gas path 22 may allow operators to maintain emissions within desired limits without compromising gas turbine efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for recirculating the flow of a hot gas flowing through a gas turbine, the system comprising:

a. a transition piece having a downstream surface defined be a support frame that extends cicumferentially around a downstream end of the transition piece, wherein said transition piece defines an outlet of a combustor of a gas turbine;

b. a stationary nozzle disposed downstream from said downstream surface of said transition piece and having an inner platform, an outer platform radially spaced from said inner platform and an airfoil that extands radially in span from said inner platform to said outer platform, said outer platform comprising a leading edge surface adjacent to said transition piece downstream surface;

c. a gap defined between said transition piece downstream surface and said stationary nozzle leading edge surface;

d. a projection having an inner arcuate surface radially separated from an outer surface, said projection extending from said stationary nozzle leading edge surface towards said transition piece downstream surface, wherein said projection at least partially decreases said gap;

e. a seal extending across said gap, said seal fixedly connected to a slot of said support frame and in contact with said stationary nozzle leading edge surface; and f. a recirculation zone at least partially defined between said projection inner arcuate surface, said stationary nozzle leading edge surface and said transition piece downstream surface.

2. The system as in claim 1, wherein at least a portion of said transition piece downstream surface is coated with a heat resistant material.

3. The system as in claim 1, wherein at least a portion of said projection is coated with a heat resistant material.

4. The system as in claim 1, wherein at least a portion of said stationary nozzle leading edge surface is coated with a heat resistant material.

5. The system as in claim 1, further comprising a purge medium supply that provides a purge medium, said purge medium supply in fluid communication with said gap.

6. The system as in claim 5, wherein said seal comprises one or more passages extending through said seal, said one or more passages providing fluid communication between said purge medium supply and said gap.

7. The system as in claim 5, wherein said purge medium supply provides said purge medium between said seal and said stationary nozzle leading edge surface into said gap.

8. The system as in claim 5, further comprising one or more purge passages that extend through said stationary nozzle leading edge surface, wherein said one or more passages provide fluid communication between said purge medium supply and said gap.

9. The system as in claim 5, further comprising one or more purge passages that extend at least partially through said transition piece downstream surface, wherein said one or more purge passages provide fluid communication between said purge medium supply and said gap.

10. A gas turbine, comprising:

a. a combustor having a transition piece, said transition piece having a downstream surface defined by a support frame that extends circumferentially around a downstream end of said transition piece, wherein said transition piece at least partially defines a hot gas path within the gas turbine and wherein said transition piece defines an outlet of said combustor;

b. a stationary nozzle, disposed downstream from said transition piece and having an inner platform, an outer platform radially spaced from said inner platform and as airfoil that extends radially in span from said inner platform to said outer platform, said outer platform comprising a leading edge surface adjacent to said transition piece downstream surface, wherein said stationary nozzle at least partially defines said hot gas path through the gas turbine and wherein said stationary nozzle defines an inlet to a turbine of said gas turbine;

c. a gap defined between said transition piece downstream surface and said stationary nozzle leading edge surface, said gap in fluid communication with said hot gas path;

d. a projection having an inner arcuate surface radially separated from an outer surface, said projection extending from said stationary nozzle leading edge surface towards said transition piece downstream surface, wherein said projection at least partially decreases said gap;

e. a seal that extends across said gap, said seal fixedly connected at one end to a slot of said support frame of said transition piece and in contact with said stationary nozzle leading edge surface; and f. a recirculation zone defined at least partially between said projection inner arcuate surface, said stationary nozzle leading edge surface and said transition piece downstream surface, wherein said recirculation zone is in fluid communication with said hot gas path.

11. The gas turbine as in claim 10, wherein at least a portion of said transition piece downstream surface is coated with a heat resistant material.

12. The gas turbine as in claim 10, wherein at least a portion of said projection is coated with a heat resistant material.

13. The gas turbine as in claim 10, wherein at least a portion of said stationary nozzle leading edge surface is coated with a heat resistant material.

14. The gas turbine as in claim 10, further comprising a purge medium supply that provides a purge medium to said gas turbine, wherein said purge medium supply is in fluid communication with said gap.

15. The gas turbine as in claim 14, wherein said seal comprises one or more purge passages that extend through said seal, said purge medium supply providing said purge medium through said one or more purge passages into said gap.

16. The gas turbine as in claim 14, wherein said purge medium supply provides said purge medium between said seal and said stationary nozzle leading edge surface into said gap.

17. The gas turbine as in claim 14, further comprising one or more purge passages that extend at least partially through at least one of said stationary nozzle leading edge surface or said projection, wherein said purge medium supply provides said purge medium through said one or more purge passages into said gap.

18. The gas turbine as in claim 14, further comprising one or more purge passages that extend through said transition piece downstream surface, wherein said purge medium supply provides said purge medium through said one or more purge passages into said gap.

* * * * *